US008322687B2

(12) United States Patent
Faccio et al.

(10) Patent No.: US 8,322,687 B2
(45) Date of Patent: Dec. 4, 2012

(54) INTEGRATED WEDGE LOCK ARRANGEMENT

(75) Inventors: Timothy J. Faccio, Sherrard, IL (US); Christopher R. Perkins, Lynn Center, IL (US)

(73) Assignee: Lift Systems, Inc., Moline, IL (US)

( * ) Notice: Subject to any disclaimer, the term of this patent is extended or adjusted under 35 U.S.C. 154(b) by 897 days.

(21) Appl. No.: 12/427,551

(22) Filed: Apr. 21, 2009

(65) Prior Publication Data

US 2009/0263225 A1 Oct. 22, 2009

Related U.S. Application Data

(60) Provisional application No. 61/046,949, filed on Apr. 22, 2008.

(51) Int. Cl.
*B66F 17/00* (2006.01)
*B66C 23/88* (2006.01)

(52) U.S. Cl. ..... 254/104; 212/292; 188/67; 187/372

(58) Field of Classification Search ..... 254/102, 254/104; 414/718, 630; 212/292, 203, 350, 212/348; 188/67, 43, 44, 72.7, 72.6, 136, 188/151 A, 170, 189; 187/359, 372, 376, 187/378; *B66C 23/69, 17/00, 19/00, 23/00; B66F 17/00*

See application file for complete search history.

(56) References Cited

U.S. PATENT DOCUMENTS

| | | | | |
|---|---|---|---|---|
| 1,389,867 | A | 9/1921 | Griffin | |
| 2,508,835 | A * | 5/1950 | Moon et al. | 52/121 |
| 2,970,445 | A * | 2/1961 | Suderow | 405/199 |
| 4,041,711 | A * | 8/1977 | Lucas | 405/197 |
| 4,234,060 | A | 11/1980 | Barsted | |
| 4,255,069 | A | 3/1981 | Yielding | |
| 4,381,839 | A | 5/1983 | Engler et al. | |
| 4,431,215 | A | 2/1984 | Moyer | |
| 4,573,853 | A | 3/1986 | Lorenz | |
| 4,790,515 | A * | 12/1988 | Pocci | 254/104 |
| 4,919,571 | A | 4/1990 | Sala et al. | |
| 4,934,869 | A | 6/1990 | Brandon et al. | |
| 5,167,284 | A * | 12/1992 | Leismer | 166/374 |

(Continued)

FOREIGN PATENT DOCUMENTS

DE 1961283 A1 9/1970

OTHER PUBLICATIONS

Form PCT/ISA/237, Written Opinion of the International Searching Authority, International Application No. PCT/US2009/041283, dated Jun. 12, 2009.

(Continued)

*Primary Examiner* — Lee D Wilson
*Assistant Examiner* — Marc Carlson
(74) *Attorney, Agent, or Firm* — Leydig, Voit & Mayer, Ltd.

(57) ABSTRACT

A hydraulically operated wedge lock system provides a releasable mechanical lock between telescoping boom segments. Each wedge lock mechanism includes a stationary backing wedge block that defines an angled smooth surface. A stationary shaft and piston is supported generally parallel to the backing wedge block. A slidable wedge block biased by a spring to a locked position is supported for reciprocal movement on the shaft along the angled smooth surface. Hydraulic fluid urges the slidable wedge block against the bias of the spring to an unlocked position.

18 Claims, 5 Drawing Sheets

U.S. PATENT DOCUMENTS

| | | | | |
|---|---|---|---|---|
| 5,181,693 | A | 1/1993 | Lorenz | |
| 6,474,486 | B1 * | 11/2002 | Baraniak | 212/292 |
| 6,685,038 | B1 * | 2/2004 | Johnston et al. | 212/203 |
| 7,124,861 | B2 * | 10/2006 | Maher | 188/72.7 |
| 7,980,298 | B2 * | 7/2011 | Halse | 166/75.14 |

OTHER PUBLICATIONS

Form PCT/IB/373, International Preliminary Report on Patentability, International Application No. PCT/US2009/041283, dated Oct. 26, 2010.

Form PCT/ISA/210, International Search Report, International Application No. PCT/US2009/041283, dated Jun. 24, 2009.

Lift Systems, Inc., Brochure, *The 500 Ton—35 Wedgelock Power Tower*, 2 pages.

Drawings and renderings of prior art, hydraulic linkage driven wedge locks described in the specification.

European Patent Office, Extended European Search Report in European Patent Application No. 09733743 (Mar. 23, 2012).

* cited by examiner

INTEGRATED WEDGE LOCK ARRANGEMENT

CROSS-REFERENCE TO RELATED APPLICATIONS

This patent application claims the benefit of U.S. Provisional Patent Application No. 61/046,949, filed Apr. 22, 2008, the entire specification and drawings of which are incorporated by reference herein.

BACKGROUND OF THE INVENTION

This invention relates to vertical lift booms or jacks. More particularly, it relates to hydraulic lift booms having an external mechanical wedge lock arrangement. Extendable hydraulic lift towers are an integral part of gantry equipment employed to lift and move heavy loads. Typically, the tower comprises a series of telescoping rectangular boom segments or stages operated by one or more internal or external hydraulic cylinders.

Safety concerns dictate use of mechanical locks between boom segments to provide positive position retention to supplement the hydraulic support. Such protection is useful, for example, when a load is elevated for prolonged periods.

One arrangement, known to the industry, is illustrated in FIG. 1 There, the vertical lift mechanism 10 includes a base boom segment 12 and extendable telescoping segments 14 and 16 powered by an internal hydraulic cylinder, such as cylinder 120, illustrated in FIG. 3. Vertical hollow base 12 is of rectangular cross section and two telescoping, vertically slidable boom segments 14 and 16 extend from the base. A top platen 18 receives the load to be lifted. It is supported on a top stage boom segment 17 manually adjustable vertically relative to boom segment 16. Top stage boom segment 17 is fixed to stage 16 at adjustable vertical positions by cross rods 19. The hydraulic cylinder is internal to the base and movable segments or stages and is extendable to vertically extend boom segments 14 and 16 relative to the base 12 to lift the load on platen 18.

The lift mechanism 10 is equipped with external wedge lock mechanisms generally designated 30. Each mechanism 30 includes a pair of lock blocks 32 fixed to a rotatable shaft 34 mounted on brackets 36 supported on one of the boom segments for coaction with the next adjacent upper segment. Each shaft 34 includes a bell crank 38 connected to a horizontal hydraulic cylinder actuator 40 comprising a hydraulic cylinder 42 and actuator shaft 44. A spring 46 on each cylinder actuator urges the actuator to its extended position. When so extended, the bell cranks 38 are rotated to urge the lock blocks 32 into locking engagement with the external surface of the adjacent boom segment.

The hydraulic cylinder actuators 40 are coordinated with the lift cylinder. The lift cylinder is enabled to sustain the load on platen 18 and actually extend the telescoping boom segments a short distance vertically upward before pressurizing cylinders 42. Once pressurized, the cylinders 42 cause the cylinder actuators 40 to shorten, operating the bell cranks and causing the associated lock blocks 32 to disengage from the side walls of the adjacent boom segment. Once the blocks 32 are disengaged, the lift cylinder is caused to permit the load to descend and the telescoping booms 14 and 16 move downwardly into base 12.

While the system described above is effective and reliable, it is composed of relatively light weight shafts and linkages that must operate in the field where the equipment is subject to rough treatment.

The wedge lock system of the present invention completely eliminates the shaft and linkage components. It integrates the actuating cylinders and wedge blocks into individual enclosed assemblages. Also, as mounted on the beam segments of the lift tower, the wedge locks and operating cylinders are surrounded by protective structure reducing exposure to damage from external sources.

DETAILED DESCRIPTION OF ILLUSTRATED EMBODIMENT

Turning now to FIGS. 2-7 there is illustrated a vertical lift mechanism 110 incorporating the principles of the present invention.

Figure 1:
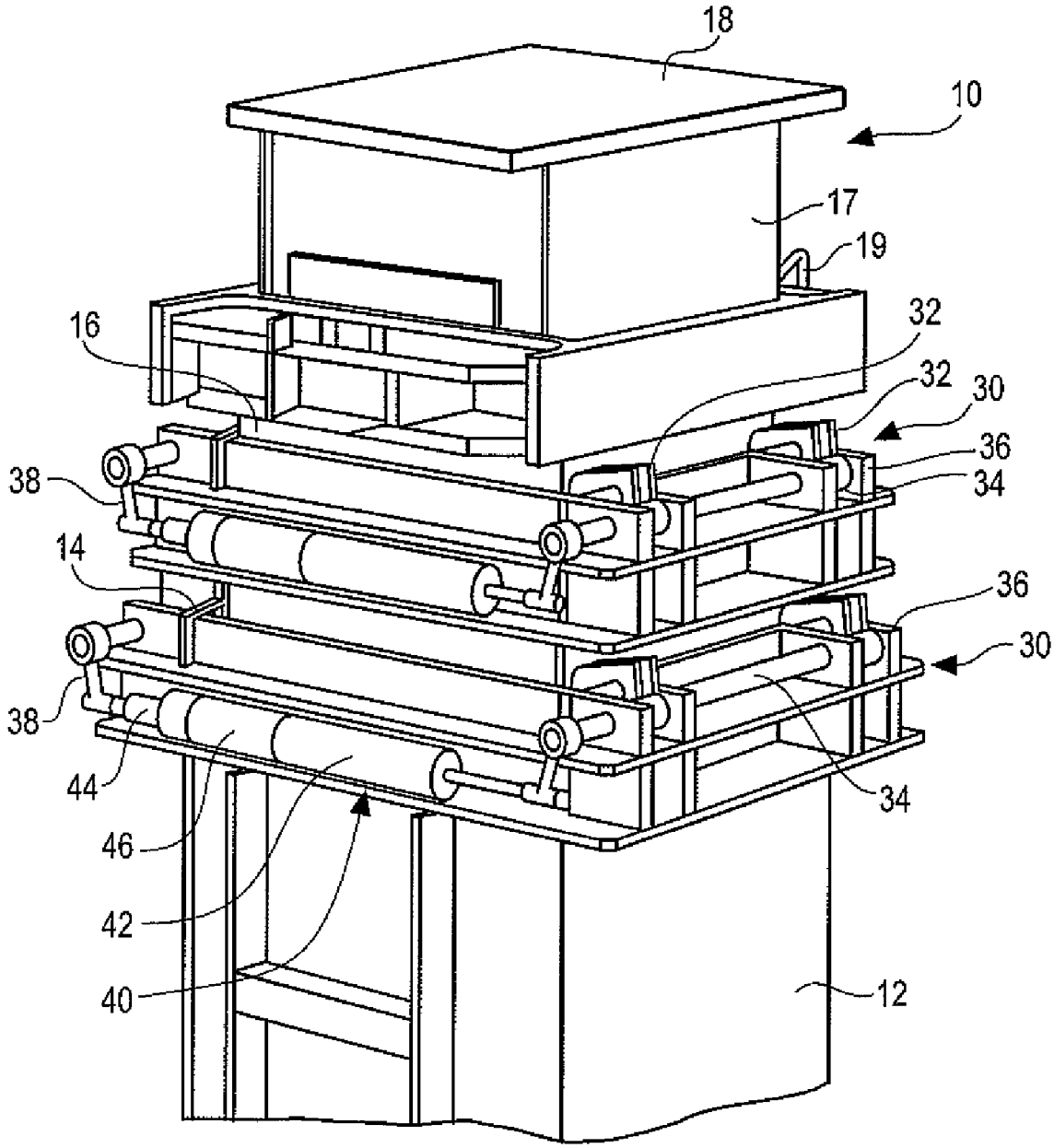
Fig. 1 Prior Art
FIG. 1 is a perspective view of a vertical lift mechanism illustrating the prior art wedge lock configuration.
Figure 4:
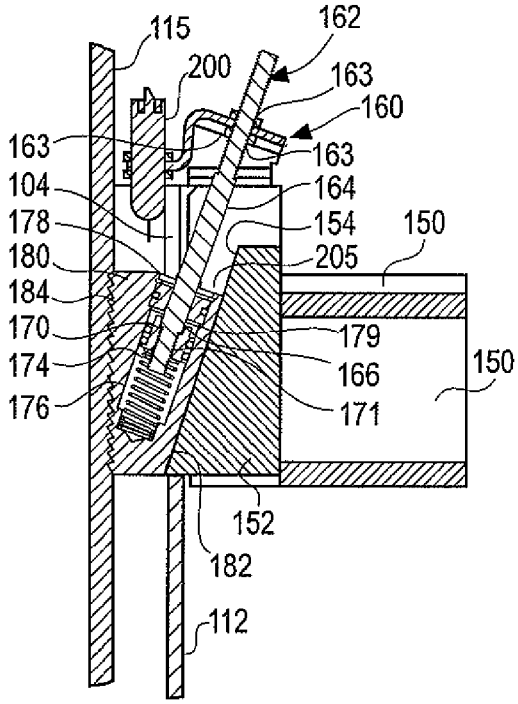
FIG. 4 is a fragmentary sectional view of the wedge lock arrangement of the present invention showing the hydraulic cylinder unpressurized and wedge lock block urged by the associated spring into locking engagement with the outer surface of the adjacent boom segment.

A base boom segment 112, of the generally rectangular cross section, supports a movable boom segment 114 in telescoping relation. An extendable and retractable hydraulic cylinder 120, shown in FIG. 4, is disposed within the boom segments and is connected to a hydraulic circuit to extend and retract telescoping boom segment 114 relative to base boom segment 112. A platen 1 18 at the upper end of boom segment 114 carries the load to be lifted. If desired, a manually operable boom segment, such as the boom segment 17 illustrated in FIG. 1 could be incorporated in the uppermost boom segment 114. In that instance, the platen 118 would be the top plate of that segment.

In the illustrated embodiment, the wedge lock system includes four mechanisms generally designated 130, supported in oppositely facing pairs on the base boom segment 112 in operative relation to the vertical side walls 115 of telescoping boom segment 114. These wedge lock mechanisms are operable to mechanically lock the telescoping boom segment 114 against retraction. They are also operable to release the boom segment 114 to permit it to move downwardly and lower the platen 118 and the carried load.

It should be noted that the number of telescoping booms employed is not relevant to the invention. It is contemplated that the wedge lock mechanism of the present invention is suitable for application between each hydraulically supported, relatively moveable telescoping boom segment configuration.

Figure 2:
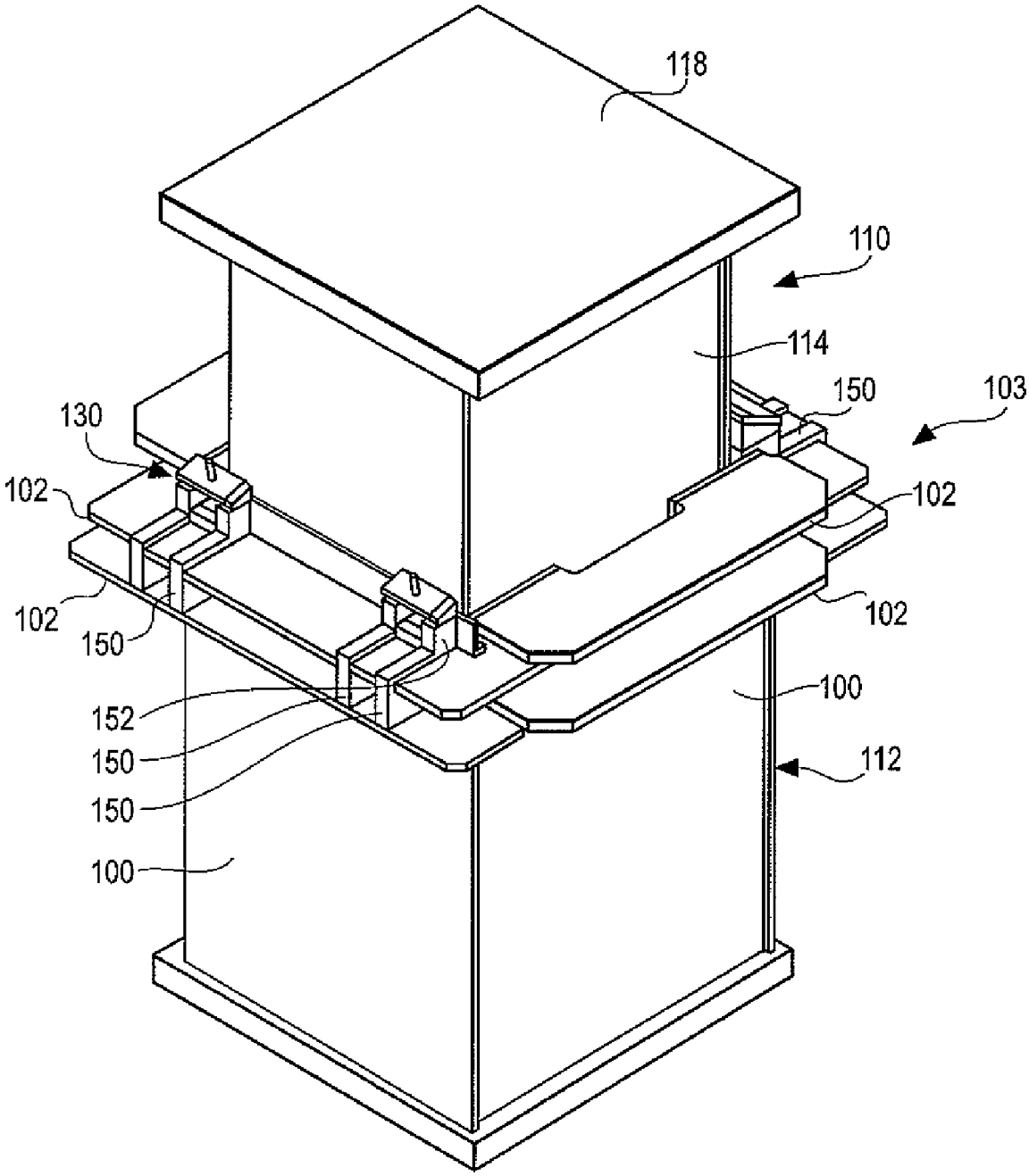
FIG. 2 is a perspective view of a vertical lift mechanism with a wedge lock configuration illustrative of the present invention.
Figure 3:
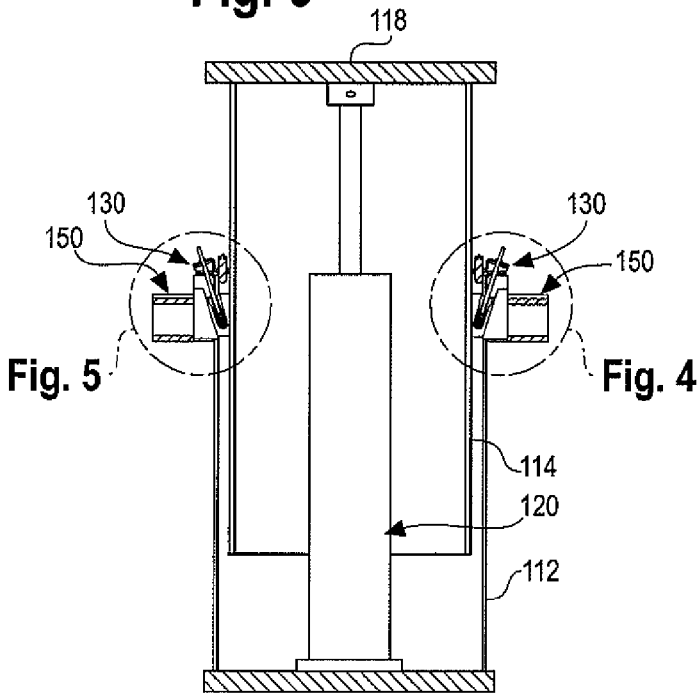
FIG. 3 is a sectional side elevational view of the lift mechanism of FIG. 2 illustrating the location of the wedge lock mechanisms.

As best seen in FIG. 2 the base boom segment 112 includes vertical walls or plates 100 secured together to form the rectangular vertical boom segment 112. At its upper end the base boom segment 112 includes a series of horizontal stiffening ribs 102 forming a collar around the upper end of boom segment 112. The collar 103 adds the necessary strength to the open end of the base boom 112. This structure is well known and is provided to enable the load on platen 118 to be safely transferred to the base boom structure by the wedge lock mechanisms 130.

Figure 5:
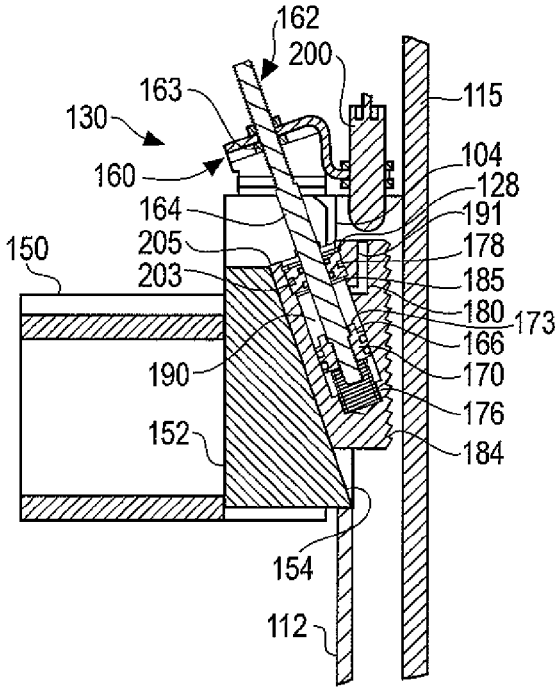
FIG. 5 is a fragmentary sectional view of the wedge lock arrangement of the present invention showing the associated hydraulic cylinder pressurized and the wedge lock block disengaged and moved away from the outer surface of the adjacent boom segment.
Figure 6:
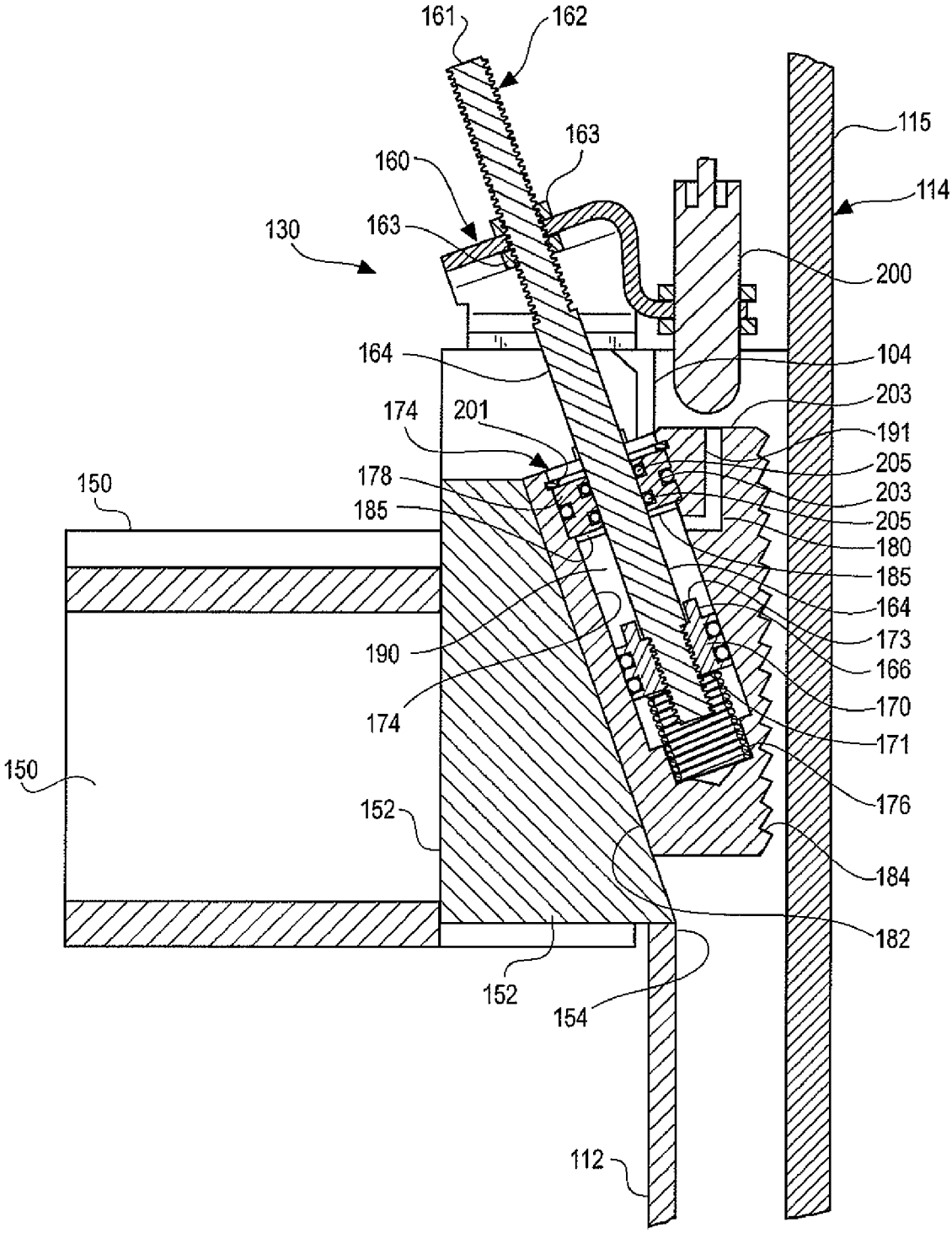
FIG. 6 is a fragmentary sectional view, on an enlarged scale, showing the details of the wedge lock configuration of the present invention.

Best seen in FIGS. 4-6 each wedge lock mechanism 130 includes a pair of vertical structural supports 150 secured to the sidewall 100 of base boom segment 112. The vertical structural supports are also secured to the stiffening ribs 102 of the surrounding collar 103. The side wall 100 of the base boom includes a cut-out or slot 104 between each pair of vertical structural supports sufficiently wide to permit access to the side wall 115 of the relatively movable telescoping boom segment 114.

Each pair of supports 150 includes a backing wedge block 152 with an angled surface 154 that diverges upwardly relative to the associated side wall 115 of the movable upper telescoping boom segment 114. As illustrated, the angle of surface 154 is approximately 20° to the vertical, though it is contemplated that other angles may be used if desired.

Each mechanism 130 also includes a wedge block 180 slidable relative to backing wedge block 152 between a locked engagement with side wall 115 of movable boom segment 114 and an unlocked position disengaged from side wall 115. The mechanisms impart a mechanical force to urge the wedge blocks 180 to the locked or engaged position which is overcome by hydraulic force to disengage the wedge blocks.

Each mechanism 130 includes a shaft 162 with an outer smooth surface 164 and a threaded end 161. Opposite, or lower end of shaft 162 is a somewhat smaller diameter and defines a shoulder 166. A stationary piston 170 abuts the shoulder 166. The outer cylindrical surface of piston 170 includes two grooves that house 0-ring seals. Stationary piston 170 includes a bottom spring seat surface 171 (see FIG. 6). It also includes an upward facing surface 173.

Slidable wedge block 180 is supported for reciprocal movement on shaft 162. Block 180 includes a planar smooth surface 182 that is parallel to the longitudinal extent of shaft 162 that slides on angled surface 154 of stationary backing block 152. A vertical serrated locking surface 184 formed at an angle of about 20° to planar smooth surface 182 extends parallel to the side wall 115 of the movable telescoping boom segment 114. It is spaced relative to the boom segment surface such that when the slidable block approaches its lower limit of travel along shaft 162 the block 180 is wedged between angled surface 154 of backing block 152 and the vertical side wall 115 of movable boom segment 114 with the serrated surface 184 in locking engagement with surface 115 (see FIG. 4). At the upper limit of movement of block 180, serrated surface 184 is spaced from side wall 115 of boom segment 114 (see FIG. 5-6).

Block 180 includes a cylindrical counter-bore 174 that defines a spring receptacle at its downward terminus. A compression coil spring 176 extends between the spring receptacle and spring seat surface 171 on stationary piston 170. Spring 176 urges the block downwardly relative to stationary piston 170. The spring is of a size that it applies sufficient force on the movable block 180 to urge serrated surface 184 into engagement with the side wall 115 of movable boom segment 114.

An annular gland 178 is fixed against shoulder 179 in counter bore 174 of slidable wedge block 180. It includes an inner or downward facing surface 185 facing upper facing surface 173 of piston 170. Gland 178 is held in bore 174 by spring clip 201. It is maintained in fluid tight relation at the upper open end of bore 174 of slidable wedge block 180 by O-ring seal 203. It is movable with slidable block 180 relative to stationary shaft 162. Seals 205 seal against smooth cylindrical surface 164 on shaft 162.

Upper surface 173 of piston 170 that faces toward gland 178 and downward facing surface 185 of gland 178 that faces toward piston 170 define a fluid chamber 190 in bore 174. The compression spring 176 urges the wedge block 180 to the lower limit of its travel relative to shaft 162 and stationary piston 170, minimizing the axial length of fluid chamber 190. At this position the smooth planar surface 182 of the wedge block 180 is wedged against angled surface 154 of backing block 152 and vertical serrated locking surface 184 in wedged against the vertical side wall 115 of telescoping boom segment 114.

Figure 7:
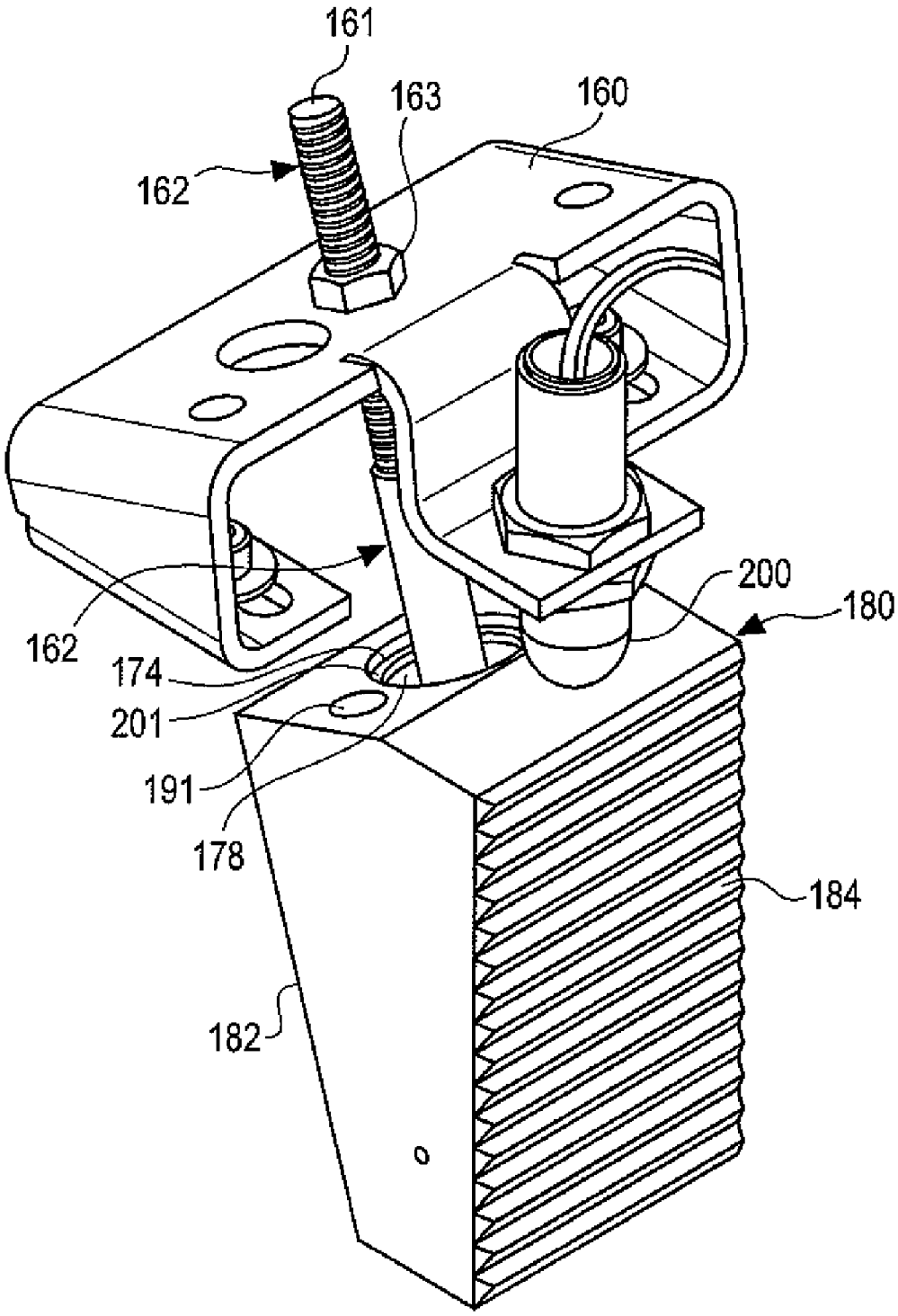
FIG. 7 is a perspective view of the movable wedge lock block, support shaft, attachment bracket, and proximity sensor.

As best seen in FIGS. 4-6, a support bracket 160 shown in FIG. 7, connects to supports 150. It supports angled shaft 162 with threaded end 161 fixed to the bracket 160, by adjustment nuts 163. Shaft 162 is disposed at the same upward angle diverging from side wall 115 as the surface 154 of backing wedge 152. The adjustment nuts permit accurate longitudinal adjustment of the shaft relative to the bracket 160 as necessary to position the mechanism relative to the cooperating side wall surface 115 of the movable boom segment 114. At installation the lower nut 163 is adjusted along threaded shaft portion 161 such that the spring 176 is compressed approximately one quarter (¼) inch. The upper nut is then tightened against the top of support bracket 160 to fix the position of piston 170 relative to spring 176 and gland 178. Such adjustment ensures that each wedge block 180 is properly positioned relative to the side wall 115.

To release the movable block 180 from locking engagement with side wall 115 of telescoping boom segment 114, pressurized hydraulic fluid is delivered to the chamber 190 through a pressurized fluid line connected to a port or passage 191 shown schematically in FIGS. 6 and 7. The fluid urges gland 178 and consequently slidable wedge block 180, upward relative to piston 170 along shaft 162 approximately one (1) inch of travel. This movement moves the wedge block 180 out of engagement with sidewall 115. As in the earlier systems the lift cylinder 120 must be activated to momentarily raise the telescoping boom segment 114 and its associated load to relieve the forces acting on wedge blocks 180. Once the serrated surfaces 184 are disengaged from wall 115, the lift cylinder 120 is operated to lower the load.

A proximity sensor 200 is supported on each bracket 160. It senses when the movable wedge blocks 180 are retracted. Suitable electrical circuitry interfaces with the hydraulic circuit to permit downward movement of the telescoping boom segment 114 only when retraction of the slidable wedge blocks 180 is recognized.

The integrated wedge lock arrangement 130 disclosed incorporates the hydraulic actuator within the movable wedge lock block 180. It also eliminates the linkages and shafts associated with the prior system to simplify the mechanical movement involved in operating the wedge lock block mechanism. Moreover, the engagement springs 176 act directly on the wedge lock blocks 180 to urge them into the normally engaged position. On pressurization of the chambers 190, the hydraulic forces on surfaces 185 of glands 178 and surface 173 of piston 170 overcome the spring force and expand the chamber 190 causing wedge lock blocks 180 to slide upwardly upon planar smooth surface 182 of the fixed shafts 162 out of engagement with the side wall surfaces 115 of the extendable boom segment 114.

Importantly, it is to be understood that the illustrated and described operational features of the wedge lock system are exemplary, and any number of other operating configurations may be utilized if desired. Accordingly, it is to be understood that the use of any and all examples, or exemplary language provided herein, is intended merely to better illuminate the invention and does not pose a limitation on the scope of the invention unless otherwise stated.

No language in the specification is to be construed as indicating any non-claimed element as essential to the practice of the invention. Preferred embodiments of this invention are described herein, including the best mode known to the inventors for carrying out the invention. Variations of those preferred embodiments may become apparent to those of ordinary skill in the art upon reading the foregoing description. The inventors intend for the invention to be practiced otherwise than as specifically described herein.

We claim:

1. A wedge lock mechanism to provide a release mechanical lock between relatively movable telescoping boom segments, comprising:

a backing wedge block for connection to a relatively stationary boom segment defining a smooth surface angled to diverge relative to an associated surface of a relatively movable telescoping boom segment;

a stationary shaft supported generally parallel to said angled surface of said backing wedge block;

a stationary piston secured to said shaft at an end thereof;

a slidable wedge block including a bore having a closed end , said stationary piston disposed in said bore, and said slidable wedge block supported for reciprocal movement on said angled surface of said backing wedge block, said bore defining a receptacle between said closed end of said bore and said stationary piston and;

a compression spring disposed in said receptacle between said stationary piston and said closed end of said bore, said spring biased to urge said closed end of said bore away from said stationary piston.

2. A wedge lock mechanism as claimed in claim 1 wherein said slidable wedge block includes a smooth surface slidable on said smooth surface of said backing wedge block and a serrated locking surface to engage the side wall of the relatively movable boom segment.

3. A wedge lock mechanism as claimed in claim 2 wherein said slidable wedge block includes a removable gland secured in said bore surrounding said shaft and defining a fluid chamber between said gland and said stationary piston.

4. A wedge lock mechanism as claimed in claim 3 wherein said piston includes a seal interposed between said piston and said bore of said slidable wedge block.

5. A wedge lock mechanism as claimed in claim 4 wherein said gland includes a seal between said gland and said bore of said slidable wedge block and a seal between said gland and said shaft.

6. A wedge lock mechanism as claimed in claim 5 wherein said slidable wedge block defines a hydraulic port in fluid communication with said chamber.

7. A wedge lock mechanism as claimed in claim 6 wherein said mechanism includes a pair of side walls secured to said backing wedge block to connect said mechanism to the relatively stationary boom segment, and a bracket supported by said side walls, said bracket supporting said stationary shaft and having an aperture to receive said shaft, said shaft including a threaded portion adjacent another end of said shaft extending through said aperture.

8. A wedge lock mechanism as claimed in claim 4 wherein said shaft includes a securement nut on each side of said bracket each said nut engaged with said threads.

9. A wedge lock mechanism as claimed in claim 8 wherein said mechanism includes a proximity switch to recognize the position of said slidable wedge block relative to said shaft.

10. A vertical lift boom including a base boom segment and a relatively movable telescoping boom segment, at least one hydraulic cylinder operable to extend and retract said relatively movable telescoping boom segment, each said boom segment including a generally vertical side wall, said side wall of said relatively movable boom segment slidable relative to said side wall of said base boom segment, a wedge lock mechanism to provide a releasable mechanical lock between relatively movable telescoping boom segments, comprising:

a backing wedge block for connection to a relatively stationary boom segment defining a smooth surface angled to diverge relative to said side wall of said relatively movable telescoping boom segment;

a stationary shaft supported generally parallel to said angled surface of said backing wedge block;

a stationary shaft supported generally parallel to said angled surface of said backing wedge block;

a stationary piston secured to said shaft at an end thereof;

a slidable wedge block including a bore having a closed end , said stationary piston disposed in said bore, and said slidable wedge block supported for reciprocal movement on said angled surface of said backing wedge block, said bore defining a receptacle between said closed end of said bore and said stationary piston and;

a compression spring disposed in said receptacle between said stationary piston and said closed end of said bore, said spring biased to urge said closed end of said bore away from said stationary piston.

11. A vertical lift boom as claimed in claim 10 wherein said slidable wedge block includes a smooth surface slidable on said smooth surface of said backing wedge block and a serrated locking surface to engage said side wall of said relatively movable boom segment.

12. A vertical lift boom as claimed in claim 11 wherein said slidable wedge block includes a removable gland secured in said bore surrounding said shaft and defining a fluid chamber between said gland and said station piston.

13. A vertical lift boom as claimed in claim 12 wherein said piston includes a seal interposed between said piston and said bore of said slidable wedge block.

14. A vertical lift boom as claimed in claim 13 wherein said gland includes a seal between said gland and said bore of said slidable wedge block and a seal between said gland and said shaft.

15. A vertical lift boom as claimed in claim 12 wherein said slidable wedge block defines a hydraulic port in fluid communication with said chamber.

16. A vertical lift boom as claimed in claim 14 wherein said mechanism includes a pair of side walls secured to said backing wedge block to connect said mechanism to the relatively stationary boom segment, and a bracket supported by said side walls, said bracket supporting said stationary shaft and having an aperture to receive said shaft, said shaft including a threaded portion adjacent another end of said shaft extending through said aperture.

17. A vertical lift boom as claimed in claim 16 wherein said shaft includes a nut securement on each side of said bracket, each said nut engaged with said threads.

18. A vertical lift boom as claimed in claim 17 wherein said mechanism includes a proximity switch supported above said slidable wedge block to recognize the position of said slidable wedge block relative to said shaft.

* * * * *

UNITED STATES PATENT AND TRADEMARK OFFICE

CERTIFICATE OF CORRECTION

PATENT NO. : 8,322,687 B2
APPLICATION NO. : 12/427551
DATED : December 4, 2012
INVENTOR(S) : Timothy J. Faccio and Christopher R. Perkins It is certified that error appears in the above-identified patent and that said Letters Patent is hereby corrected as shown below:

Column 5, line 25 (claim 1, line 1) change “release” to “releasably”

Signed and Sealed this
Fifth Day of February, 2013

Teresa Stanek Rea
*Acting Director of the United States Patent and Trademark Office*